US006544407B1

(12) United States Patent
Calemma et al.

(10) Patent No.: US 6,544,407 B1
(45) Date of Patent: Apr. 8, 2003

(54) PROCESS FOR THE PREPARATION OF MIDDLE DISTILLATES STARTING FROM LINEAR PARAFFINS

(75) Inventors: Vincenzo Calemma, San Donato Milanese (IT); Stefano Peratello, Nova Milanese (IT); Carlo Perego, Carnate (IT); Silvia Pavoni, Limito di Pioltello (IT); Silvia Guanziroli, Monza (IT)

(73) Assignees: Agip Petroli S.p.A., Rome (IT); Enitecnologie S.p.A., San Donato Milanese (IT)

( * ) Notice: Subject to any disclaimer, the term of this patent is extended or adjusted under 35 U.S.C. 154(b) by 96 days.

(21) Appl. No.: 09/714,136

(22) Filed: Nov. 17, 2000

(30) Foreign Application Priority Data

Nov. 19, 1999 (IT) ..... MI99A002425
Aug. 4, 2000 (IT) ..... MI2000A 001819

(51) Int. Cl.[7] ..... C10G 47/12
(52) U.S. Cl. ..... 208/111.35; 208/109; 208/110; 208/111.01; 208/950
(58) Field of Search ..... 208/109, 110, 208/111.01, 111.35, 950

(56) References Cited

U.S. PATENT DOCUMENTS

| | | | | |
|---|---|---|---|---|
| 3,535,232 A | * | 10/1970 | Lawrance et al. | 208/111.15 |
| 4,385,193 A | * | 5/1983 | Bijwaard et al. | 502/242 |
| 4,594,468 A | * | 6/1986 | Minderhoud et al. | 208/110 |
| 5,049,536 A | * | 9/1991 | Bellussi et al. | 502/235 |
| 6,068,757 A | * | 5/2000 | Walker, III | 208/111.01 |

FOREIGN PATENT DOCUMENTS

| | | | |
|---|---|---|---|
| EP | 0 221 405 A2 | | 5/1987 |
| EP | 0532116 A1 | * | 3/1993 |
| EP | 0 537 815 A1 | | 4/1993 |
| EP | 0 550 922 A1 | | 7/1993 |
| EP | 0 582 347 A1 | | 2/1994 |
| EP | 0583836 A1 | * | 2/1994 |
| EP | 0 590 714 A1 | | 4/1994 |
| EP | 0 659 478 A1 | | 6/1995 |
| EP | 0 908 231 A1 | | 4/1999 |
| GB | 1451617 | * | 10/1976 |

* cited by examiner

*Primary Examiner*—Walter D. Griffin
(74) *Attorney, Agent, or Firm*—Oblon, Spivak, McClelland, Maier & Neustadt, P.C.

(57) ABSTRACT

Process for the preparation of a middle distillate having good properties at low temperatures, which can be used as fuel, starting from a mixture of substantially linear hidrocarbons, without sulfur and containing at least 20% of a high-boiling fraction having a distillation temperature exceeding 370° C., comprising, as single reactive step, a "hydrocracking" step on said mixture of linear hydrocarbons, at a temperature ranging from 250 to 450° C. and a total pressure of 0.5 to 15 MPa, in the presence of a supported catalyst comprising:

(A) a carrier of an acid nature consisting of a calcined gel of silica-alumina amorphous to X-rays having a molar ratio between silica and alumina within the range of 30 and 500, a surface area within the range of 500 and 1000 $m^2/g$, with a porosity within the range of 0.2 and 0.8 ml/g, with an average pore diameter ranging from 10 to $40 \cdot 10^{-10}$ m (from 10 to 40 Å);

(B) one or more noble metals of groups 8, 9 or 10 of the periodic table of elements, arranged on said carrier (A) in a quantity ranging from 0.05 to 5.0% by weight.

21 Claims, 1 Drawing Sheet

PROCESS FOR THE PREPARATION OF MIDDLE DISTILLATES STARTING FROM LINEAR PARAFFINS

BACKGROUND OF THE INVENTION

1. Field of the Invention

The present invention relates to a process for the preparation of middle distillates starting from prevalently paraffinic charges.

More specifically, the present invention relates to a process for the production of middle distillates in a single reactive step comprising a hydrocracking reaction, starting from charges prevalently consisting of mixtures of n-paraffins in which a significant fraction has a boiling point higher than that of middle distillates.

2. Description of the Background

Mixtures of hydrocarbons comprising a relevant fraction with a high boiling point are normally obtained as distillation residue in refining processes of fuels of petroleum origin. More recently, mixtures of hydrocarbons with a high boiling point have also been obtained from certain degradation processes and recycling of polymeric materials. The production of hydrocarbon mixtures, essentially consisting of n-paraffins, in which a significant fraction has a boiling point exceeding 370° C., by means of direct synthesis from mixtures of hydrogen and carbon monoxide (synthesis gas) in so-called Fischer-Tropsch processes, from the name of the inventors of the first synthesis of this type in the thirties', is also well known.

The above mixtures are normally in solid or semi-solid form (waxes) at room temperature and in no case can be used as fuels or lubricants in this form. However, they represent a raw material which is potentially very significant as an energy source and for other uses, and are therefore subjected to various kinds of degradative and/or regradative treatment to improve their characteristics and allow them to be used as fuels. In particular, due also to the present tendency in the fields of automobile and air transport, in which there is an increasing demand for Jet Fuel and high quality gasolines for Diesel cycle engines, the necessity is strongly felt for obtaining, with the least possible number of steps and maximum yield, mixtures with typical properties of so-called "middle distillates".

The term middle distillates usually refers to a mixture of hydrocarbons with a range of boiling points corresponding to those of "kerosene" and "gas oil" fractions obtained during the atmospheric distillation of petroleum. In this distillation, the boiling point range which defines the "middle distillate" generally ranges from 150 to 370° C. The middle distillate cut consists in turn of: 1) one or more kerosene fractions with a boiling range generally between 150 and 250° C.; 2) one or more gas oil fractions with a boiling range generally between 180 and 370° C.

It is known that hydrocarbon mixtures suitable for producing the above fuel cuts, with a good yield, after fractionation, can be obtained by subjecting a high-boiling mixture of hydrocarbons, normally having a distillation range exceeding 350° C., to a degradative thermal process in the presence of hydrogen. These processes, more commonly defined as "hydrocracking", are normally carried out in the presence of a bifunctional catalyst, containing a metal with a hydrogenating activity supported on an inorganic solid usually comprising an oxide or a mixture of oxides with acid characteristics.

Hydrocracking catalysts typically comprise metals of groups 6 to 10 of the periodic table of elements (in the form approved by IUPAC and published by "CRC Press Inc." in 1989, to which reference is continually made hereafter), especially nickel, cobalt, molybdenum , tungsten or noble metals such as palladium or platinum. Whereas the former are more suitable for processing hydrocarbon mixtures with relatively high sulfur contents, the noble metals are more active but are poisoned by the sulfur and require a feeding essentially without its presence.

Carriers normally used for the purpose are various types of zeolites (β, Y), X-$Al_2O_3$ (wherein X can be Cl or F), silico-aluminas, the latter amorphous or with varying degrees of crystallinity or mixtures of crystalline zeolites and amorphous oxides. A very detailed description of the various catalysts, specific characteristics and different hydrocracking processes based on these, is provided, among the many available in literature, in the publication of J. Scherzer and A. J. Gruia "Hydrocracking Science and Technology", Marcel Dekker, Inc. Publisher (1996).

The availability of high-boiling mixtures or waxes, produced directly, for example, by means of synthesis processes of the Fischer-Tropsch type, although greatly desired (absence of polycondensed aromatic compounds, asphaltenes, sulfur and nitrogen), requires however a particular selection of catalysts and process conditions which makes this alternative possible at costs competitive with the traditional sources of liquid mineral fuels.

In fact, owing to the particular growth mechanism of the hydrocarbon chains during the Fischer-Tropsch reaction, it is not achievable in practice the synthesis of a product with a narrow chain-length range. Regardless of the type of catalyst and operating conditions, the Fischer-Tropsch reaction produces a mixture of products characterized by an extremely wide molecular weight distribution, ranging from methane to normal-paraffin waxes, even containing more than 100 carbon atoms. An appropriate choice of synthesis catalyst and operating conditions allows the type of product to be varied in terms of the relative content of paraffin, olefin and oxygenated compounds in the mixture, and average hydrocarbon chain length. It is consequently possible to obtain different mixtures of hydrocarbons with a composition more or less approaching heavy products, but always with a relatively wide distribution. For example, in the case of the products obtained with catalytic systems of the most recent generation based on cobalt, which tend to produce long-chain hydrocarbons, generally only 40–60% of the hydrocarbon fraction having at least 7 carbon atoms (abbreviation $C_7^+$) consists of a middle distillate, whereas the complement to 100% consists of heavier products.

A critical element in the hydrocracking process of products coming from the Fischer-Tropsch synthesis is the reactivity of the molecules with an increase in the paraffinic chain length. To obtain high selectivities to middle distillates, using a "full range" charge (i.e. $C_5^+$), it is necessary for the reactivity towards cracking the components of the naphtha, kerosene and gas oil fractions to be much lower than that of the fraction having a boiling point higher than 370° C. (370+° C. fraction). Otherwise, during the hydrocracking reaction, a fraction consisting of middle distillates is converted to gas ($C_1$–$C_4$) and naphtha ($C_5$–$C_9$) with a consequent decrease in the selectivity to middle distillates. Another consequence which derives from not respecting the above condition is the considerable increase in the kerosene/gas oil ratio, during the reaction, even at relatively low conversion degrees of the heavy fraction (370+° C.). This is a particularly negative aspect if the yields to gas oil are to be maximized.

In the processes of the known art, there is generally a considerable increase in the kerosene/gas oil ratio and a consistent decrease in the selectivity to middle distillates at high conversion degrees of the 370+° C. fraction. In order to limit these drawbacks, when $C_5^+$ or 150+° C. charges are processed, it is normal to operate with conversions of the heavy fraction (360+° C.) ranging from 35 to 60%. Alternatively, the hydrocracking reaction is only carried out on 260+° C. or 370+° C. cuts obtained by means of a preliminary fractionation step.

Another critical aspect of hydrocracking processes of Fischer-Tropsch synthesis products is the isomerization degree of the products which, with the same range of boiling points, strongly influences their properties at low temperatures. In this respect, to obtain products which satisfy the specifications for use as fuels for car transport (Diesel) and air transport (Jet Fuel), the percentage of iso-paraffins must be relatively high. The production of middle distillates containing high percentages of iso-paraffins together with the achievement of high selectivities, however, is still a critical aspect which is faced by subjecting whole or part of the middle distillates to an isomerization process with the purpose of improving the properties at low temperatures. In any case, the end process is more complex and greater investment costs are necessary.

Various catalytic systems have been proposed in the art in an attempt to overcome the above problems. For example, in the publications of patent applications GB-A 2,077,289, EP-A 104,672, EP-A 109,702, EP-A 147,873 and EP 127,220, various mixtures of hydrocarbons coming from the Fischer-Tropsch synthesis are treated with hydrogen in the presence of a catalyst consisting of platinum supported on amorphous silica-alumina having a high alumina content (>10% by weight). In the examples provided, there is an increase in the content of middle distillates but, when indicated, the pour point of the gas oil fractions and the freezing point of the kerosene fraction are −1° C. and −35° C. respectively.

Patent applications EP-A 532,115, EP-A 532,116 and EP-A 532,117 also describe the use of catalysts based on platinum supported on amorphous silica-alumina for the production of middle distillates starting from high-boiling mixtures coming from the Fischer-Tropsch synthesis. In particular the use of amorphous silico-aluminas containing from 12 to 15% by weight of alumina with a pore volume, determined by means of "incipient wetness", preferably ranging from 1 to 1.5 ml/g, is described. The examples provided, relating to the conversion of a 370+° C. fraction, indicate selectivities to middle distillates (220–370° C. fraction) ranging from 0.50 to 0.59 within the conversion range of 44 to 86%. No information is provided as to the treatment of high-boiling mixtures with a significant initial content of middle distillates, nor to the characteristics at low temperatures of the products obtained.

Patent application EP-A 321,303 discloses a process which comprises the separation of the light fraction (290−° C.) of Fischer-Tropsch products, and sending the 290+° C. fraction to a hydrocracking/isomerization reactor for the production of middle distillates. The non-converted 370+° C. fraction can be recycled to the hydrocracking reactor or optionally sent, either entirely or partly, to a second isomerization reactor, for a further production of Jet Fuel and lube bases. The catalyst claimed for both reactors consists of platinum supported on fluorinated alumina. The examples provided indicate that by feeding the hydrocracking reactor with a 370+° C. charge, maximum yields of about 50% are obtained for a conversion of the charge ranging from 70 to 90%.

U.S. Pat. No. 5,378,348 describes a process in numerous steps for the treatment of paraffinic waxes which comprises the separation of the charge into three fractions: 1) naphtha ($C_5$–165° C.); 2) kerosene (160–260° C.); 3) residue (260+° C.). The kerosene fraction is subjected to a process in two steps: the first, a hydrotreating process to remove the olefins and oxygenated compounds; the second a hydroisomerization process to improve the properties at low temperatures. The 260+° C. fraction is sent to a hydrocracking/isomerization reactor for the production of middle distillates, and the non-converted 370+° C. fraction is recycled. The advantages deriving from the use of this scheme are higher yields to middle distillates and good properties at low temperatures. Preferred catalysts are based on a noble metal (Pt, Pd) or the pairs Ni+Co/Mo on silica alumina or silica-alumina modified by impregnation of the carrier with a precursor of silica (e.g. $Si(OC_2H_5)_4$). The examples relating to the conversion of the 260+° C. fraction, using different catalysts, indicate kerosene/gas oil ratios ranging from 0.63 to 1.1 for a conversion of 39–53% of the 370+° C. fraction. The freezing points of the 160–260° C. cut range from −43 to −25° C. whereas the pour points of the 260–370° C. fraction vary from −3 to −27° C.

From an examination of literature available, it seems that there has never been a description of a process, operating directly on a $C_7^+$ fraction, capable of producing in a single step and with high conversion degrees of the 370+° C. fraction (conversion >60%), middle distillates with high selectivities and a minimum variation in the kerosene/gas oil ratio with respect to the charged processed. The necessity has also been felt for having a catalytic system which gives rise, starting from waxy hydrocarbons and particularly from mixtures of high-boiling hydrocarbons obtained from Fischer-Tropsch processes, to the formation of middle distillates with good properties at low temperatures in terms of freezing point of the kerosene fraction and pour point of the gas oil fraction.

These characteristics, in fact, are associated with the branching degree and are difficult to optimize in a process comprising hydrocracking as single reactive step, as satisfactory branchings can usually be obtained with conversion rates which are too high, at which the gas oil fraction is excessively degraded to lighter fractions. The result is that a high branching degree seems to be incompatible with the production of a balanced conversion to kerosene and gas oil.

It is therefore necessary to have catalytic systems for hydrocracking which are further improved with respect to those used in the processes so far known, and which overcome the above drawbacks, especially in the case of the treatment of prevalently linear aliphatic hydrocarbon mixtures, such as those produced in Fischer-Tropsch processes.

SUMMARY OF THE INVENTION

Patent application EP-A 582,347 (assigned to the Applicant) describes a catalytic system capable of isomerizing with high selectivities n-paraffins having a number of carbon atoms exceeding 15 which comprises:

1. a carrier of an acid nature consisting of a silica or alumina gel amorphous to X-rays, with a molar ratio ranging from 30/1 to 500/1, having a surface area ranging from 500 to 1000 $m^2/g$, a porosity ranging from 0.3 to 0.6 ml/g and a pore diameter within the range of 10–40 Å
2. one or more noble metals of groups 8, 9 or 10 of the periodic table, deposited in a quantity ranging from 0.05 to 5% by weight.

The acid carrier of the catalyst preferably has a ratio $SiO_2/Al_2O_3$ ranging from 50/1 to 300/1 and a porosity ranging from 0.4 to 0.5 ml/g, whereas the metal or mixture of noble metals consists of platinum and/or palladium in a quantity ranging from 0.1 to 2.0% by weight.

The carrier based on silica and alumina gel can be conveniently prepared according to what is described in patent application EP-A 659,478. Said carrier can be used as such for the deposition of the metal phase (b) or in extruded form, as described for example in EP-A 550,922 and EP-A 66055. The metal phase (b) of the catalyst can be introduced by means of aqueous impregnation by wetting the extruded carrier with an aqueous solution of a compound of the desired metal or metals, or according to the method described in patent application EP-A 590,714. This is followed by calcination in an oxidating atmosphere at a temperature ranging from 200 to 600° C. These catalytic compositions can be used in the hydroisomerization of n-paraffins having over 15 carbon atoms to obtain bases for lubricating oils characterized by a low pour point and a high viscosity index.

During a varied series of tests on the behaviour of the above isomerization catalysts, the Applicant surprisingly found a particular type of catalytic composition which proved to be extremely advantageous when used in hydrocracking processes, and at the same time relatively simple to prepare, thus allowing evident progress in overcoming the drawbacks described above.

An object of the present invention therefore relates to a process for the preparation of middle distillates starting from a mixture of substantially linear hydrocarbons, consisting of at least 20% of a high-boiling fraction having a distillation temperature exceeding 370° C., said process comprising a hydrocracking step in which said mixture of linear hydrocarbons is heated in the presence of hydrogen to a temperature ranging from 250 to 450° C. and at a pressure ranging from 0.5 to 15 MPa, for a time sufficient for converting at least 40%, preferably from 60 to 95%, of said high-boiling fraction into a fraction of hydrocarbons which can be distilled at a temperature lower than 370° C.; this process is characterized in that: the hydrocracking step is carried out in the presence of a supported catalyst comprising:

(A) a carrier of an acid nature consisting of a calcined gel of silica or alumina amorphous to X-rays, having a molar ratio $SiO_2/Al_2O_3$ between silica and alumina within the range of 30 and 500, a surface area ranging from 500 to 1000 $m^2/g$, with a porosity ranging from 0.2 to 0.8 ml/g, preferably from 0.3 to 0.6 ml/g, with an average pore diameter within the range of 10 and $40 \cdot 10^{-10}$ m (between 10 and 40 Å);

(B) one or more noble metals of groups 8, 9 or 10 of the periodic table, deposited on said carrier (A) in a quantity ranging from 0.05 to 5% by weight.

DETAILED DESCRIPTION OF THE INVENTION

Figure 1:
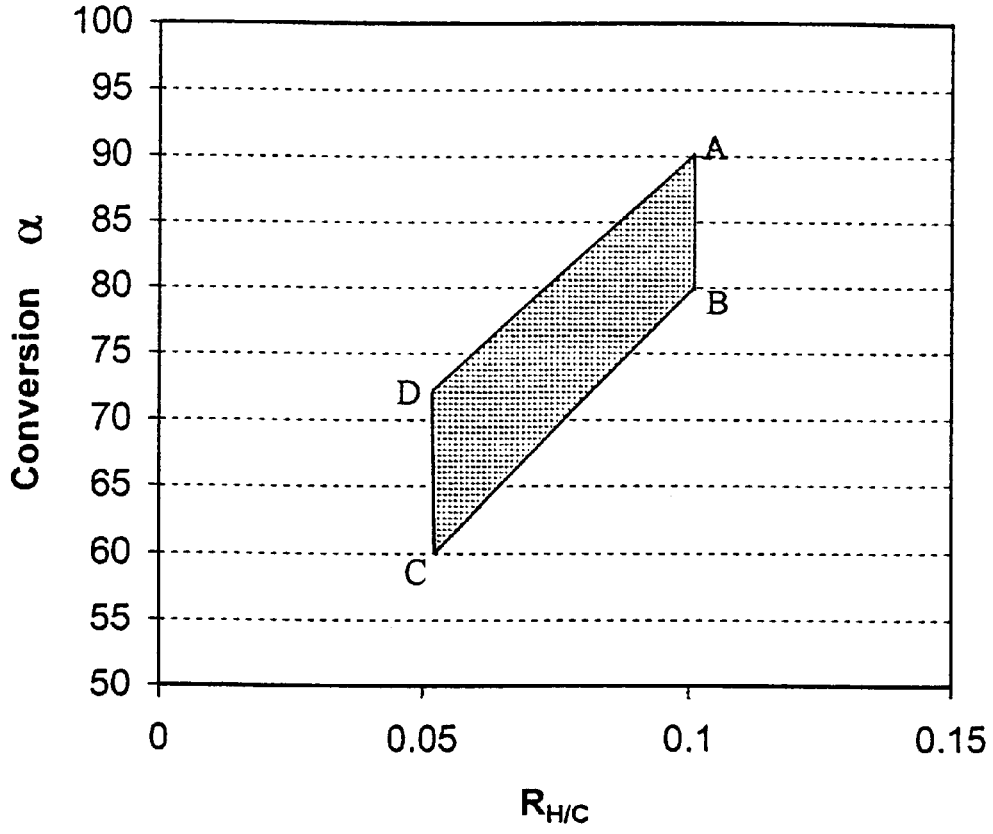
FIG. 1 is a graph of conversion degree α as a function of initial mass ratio of hydrogen to hydrocarbons $R_{H/C}$, described in further detail below.

Further objects of the present invention are evident from the rest of the present invention and examples. The meaning of some of the terms used herein are defined hereunder to clarify the description and claims of the present invention and indicate its relative scope:

"distillation temperature" referring to a hydrocarbon mixture means, unless otherwise specified, the temperature or temperature range at the head of a typical distillation column from which the mixture is collected, at normal pressure (0.1009 MPa);

"degree of conversion" "α" is defined as the mass of the 370+° C. fraction in the charge, less the mass of the 370+° C. fraction in the products, divided by the mass of the 370+° C. fraction in the charge)

the definitions of the ranges always include the extremes, unless otherwise specified;

the term "hydrocracking" is used herein with the general meaning of high-temperature catalytic treatment of a hydrocarbon mixture in the presence of hydrogen, in order to obtain a mixture with a lower boiling point;

the terms "kerosene" and "gas oil" as used herein, refer to the two hydrocarbon fractions having a distillation range from 150 to 260° C. and from 260 to 370° C., respectively;

the term "according to specification", as used hereunder with reference to "kerosene" and "gas oil" products, identifies a combination of minimum properties as indicated in Table 1 below.

TABLE 1 minimum requisites according to specification

| Jet Fuel A-1 | | Diesel | |
|---|---|---|---|
| Aromatics | ≦20% vol | Cetane number | ≧51 |
| Smoke point | ≧25 mm | CFPP[a] class 0 | ≦−20° C.; >−26° C. |
| Freezing point | ≦−47° C. | Cloud Point[a] class 0 | ≦−10° C.; >−16° C. |
| | | CFPP[b] degree D | ≦−10° C. |

[a]Arctic climate
[b]temperate climate

The data provided in the table were found in regulations ASTM D 1655–99 and EN590.

The mixture of substantially linear hydrocarbons, normally comprising a fraction of high-boiling hydrocarbons (liquid and/or solid at room temperature) and a fraction of middle distillate, in accordance with the process of the present invention, is subjected to hydrocracking treatment in the presence of a catalyst capable of converting the high-boiling fraction into middle distillates with high selectivities at high conversion rates. The middle distillate thus obtained has a limited variation in the kerosene/gas oil ratio with respect to that of the charge processed. In addition, the kerosene and gas oil fractions have good properties at low temperatures and excellent characteristics in terms of smoke point and cetane number.

In the commoner case in which the feeding mixture already comprises at least 10% by weight of middle distillate subdivided into kerosene and gas oil fractions, the process according to the present invention advantageously allows the following ratio to be obtained:

$$R_{K/G} = \frac{K_F / G_F}{K_0 / G_0}$$

wherein $K_0/G_0$ represents the weight ratio between the "kerosene" fraction and the "gas oil" fraction in the feeding mixture, preferably ranging from 0.5 to 2.0, preferably from 0.5 to 1.5, and $K_F/G_F$ represents the ratio between the same fractions in the mixture obtained at the end of said hydrocracking step and has values ranging from 0.9 to 1.3, preferably from 0.9 to 1.1, i.e. so that the ratios between kerosene and gas oil at the inlet and outlet respectively of said step, are not too different from each other.

The mixture of substantially linear hydrocarbons suitable as feeding for the process according to the present invention can comprise up to 20%, preferably up to 10%, more preferably up to 5% by weight, of a non-paraffinic organic fraction, and is characterized by a substantial absence of sulfur. In particular, the content of oxygenated organic compounds, such as alcohols or ethers, is preferably less than 5% by weight.

For an optimum embodiment of the process according to the present invention, said feeding mixture of the hydrocracking step consists of at least 90% of paraffins having from 5 to 80, preferably from 10 to 65, carbon atoms, and has a boiling point which correspondingly ranges from 35 to 675° C. (by extrapolation), preferably from 170 to 630° C. (by extrapolation). In addition, the feeding comprises at least 20% by weight, preferably from 40 to 80% by weight of a high-boiling fraction which can be distilled at a temperature ≧370° C., and up to 80%, preferably from 20 to 60% by weight of a fraction of hydrocarbons corresponding to the so-called "middle distillate", subdivided into the traditional kerosene and gas oil cuts previously defined. At least 60% by weight of said paraffins in the optimum feeding mixture are linear, which may increase up to 90% if no or very small recycle is used in the process.

The present invention does not exclude however processes in which the feeding is different from the preferred ones specified above. The mixtures of prevalently linear hydrocarbons having distillation ranges equal to or higher than 370° C. are solid or semi-solid at room temperature and for this reason are also commonly called waxes.

Typical examples of these mixtures are fractions deriving from the thermodegradation of polyolefins, certain fractions of petroleum processing and heavy fractions obtained by the direct synthesis of synthesis gas, for example those obtained by means of the Fischer-Tropsch process.

The latter in particular are characterized by the absence of sulfur and consist of over 70% by weight of linear paraffins having more than 15 carbon atoms and a boiling point exceeding 260° C. As already mentioned, these mixtures are frequently solid or semi-solid at room temperature and for this reason are defined as waxes. Not all Fischer-Tropsch synthesis processes produce mixtures of high-boiling linear paraffins. Depending on the conditions and the catalyst used, the Fischer-Tropsch process can produce mixtures within various distillation temperature ranges, even relatively low, if desired. It has been found to be more convenient, however, to carry out the process so as to prevalently obtain high-boiling mixtures or waxes, which can then be suitably degraded and fractionated into the desired distillation cuts.

It is also known that processes of the Fischer-Tropsch type produce hydrocarbon mixtures containing oxygenated hydrocarbons, normally in the form of alcohols, whose content can reach a maximum of 10% by weight with respect to the total. It has been observed that they have a reasonably negative effect on the activity of the catalyst used in the process according to the present invention. Consequently, quantities of oxygenated hydrocarbons of up to 8% by weight, preferably less than 5% by weight, can generally be tolerated in the feeding.

The particularly distinctive characteristic of the process according to the present invention is that it is carried out under conditions and with a catalyst which are such that the hydrocracking step produces a middle distillate cut with high conversions and selectivity, but at the same time maintaining the $R_{K/G}$ ratio, as defined above, unaltered. This is an advantageous and a completely surprising factor with respect to the known art.

The hydrocracking step of the process according to the present invention can generally be carried out at the temperatures and pressure of traditional processes of this type, known in the art. The temperatures are normally selected from 250 to 450° C., preferably from 300 to 370° C., whereas the pressure is suitably selected from 0.5 to 15 MPa, preferably from 1 to 10 MPa, also comprising the hydrogen pressure.

The hydrogen is used in a quantity which is sufficient to obtain the desired conversion under the pre-selected conditions. The mass ratio between hydrogen and hydrocarbons in the feeding (and the consequent relative pressure thereof) can be easily selected by the expert in the field in relation to the other essential parameters of the process, such as space velocity, contact time, catalyst activity and the temperature, in order to reach the desired conversion degree. Initial mass ratios (hydrogen)/(hydrocarbons) (indicated as $R_{H/C}$ from here onwards) ranging from 0.03 to 0.2 are usually considered as being satisfactory for carrying out the present process. Under these conditions, only a small part of the hydrogen initially introduced is used up, the residual part can be easily separated and recycled using the normal equipment suitable for the purpose. Whereas more generally, the use of mixtures of hydrogen with inert gases such as, for example, nitrogen, is not excluded, the use of essentially pure hydrogen which is commercially available however at a low cost, is normally preferred.

It has been found however that the process of the present invention is more advantageously carried out with a ratio $R_{H/C}$ comprised within the range from 0.03 to 0.10, preferably from 0.04 to 0.07, in order to achieve gasoil and kerosene fractions according to the specification.

The WHSV space velocity (measured in $h^{-1}$ and defined as mass flow-rate in g/h divided by the weight of the catalyst in grams), or the contact time (defined as the reciprocal of the space velocity: 1/WHSV), of the reagents under the hydrocracking reaction conditions, are suitably selected in relation to the characteristics of the reactor and process parameters so as to obtain the desired conversion degree. It is important for the contact time to be selected so that the conversion degree $\alpha$ (defined as hereinabove) is maintained within the values over which undesired reactions become significant which jeopardize the production of the desired levels of selectivity to "middle distillate" and maintenance of the $R_{K/G}$ ratio within the preferred values. Contact times are generally selected which allow a conversion degree $\alpha$ ranging from 60 to 90%. For $\alpha$ values higher than 0.90 (90%), the selectivity and $R_{K/G}$ ratio are not entirely satisfactory, whereas $\alpha$ values lower than 0.60 (60%) are not convenient for the economy of the process.

According to a preferred embodiment of the present invention, the $\alpha$ conversion degree and $R_{H/C}$ hydrogen/hydrocarbon ratio in the feeding have partially interdependent values. In particular, the Applicant has found that the product obtained after the hydrocracking reaction, has an optimum combination of properties at low temperatures and forms a very high quality fuel also with respect to the cetane number, when the $\alpha$ and $R_{H/C}$ parameters are in the shaded area within points ABCD, indicated in FIG. 1.

The exact values of $\alpha$ and $R_{H/C}$ corresponding to said points are reported in the following table 2.

TABLE 2

| | A | B | C | D |
|---|---|---|---|---|
| $\alpha$ | 90 | 80 | 60 | 72 |
| $R_{H/C}$ | 0.1 | 0.1 | 0.05 | 0.05 |

FIG. 1 represents a diagram of preferred $\alpha$ and $R_{H/C}$ values for the embodiment of the process according to the present invention. The scale of the $\alpha$ conversion degree is provided in ordinate, whereas the scale of $R_{H/C}$ ratios is in abscissa. The shaded area defined by points ABCD, in the form of a parallelogram, represents the combination of the preferred $\alpha$ and $R_{H/C}$ values.

Using these values of said process parameters, combined with the particular supported catalyst defined above, it is possible to obtain a kerosene and gas oil fraction according to specification with an $R_{K/G}$ ratio normally not higher than 1.3, but more frequently ranging from 0.95 to 1.1, and a selectivity to middle distillates of not less than 0.55 and preferably higher than 0.60, the hydrocracking reaction being effected under normal temperature and pressure conditions.

In accordance with a typical embodiment of the process of the present invention, a mixture of hydrocarbons having the above characteristics is preheated to a temperature ranging from 90 to 150° C., and fed in continuous, after premixing with hydrogen, to a fixed bed tubular reactor operating in down flow. The reactor is thermostat-regulated to a temperature ranging from 300 to 360° C. The pressure of the reactor is maintained at 3 to 10 MPa. The catalyst is previously activated as described hereunder, and the hydrocracking process can be subsequently carried out, usually after a stabilization phase of the catalyst (about 60–100 hours).

The feeding preferably consists of a high-boiling mixture coming from a synthesis process of the Fischer-Tropsch type and comprises from 30 to 80% of waxes with a distillation point of over 370° C., and up to 5% of oxygenated compounds. In the case of a feeding containing alcohols, especially if in an amount of more than 5% by weight, the expert in the field can optionally subject this to a preliminary treatment, previous to the hydrocracking step of the process according to the present invention, to avoid the drawbacks described above. This treatment may consist, for example, in a distillation step which removes a part of the fraction with a boiling point lower than 370° C., in which the oxygenated compounds are normally concentrated, or in subjecting the feeding mixture to a selective hydrogenation step at temperatures lower than the hydrocracking value, in the presence of one of the known catalysts suitable for the purpose, which reduces the cracking to the minimum, in order to eliminate the —OH group and produce non-oxygenated hydrocarbons and a small quantity of water which is easily removed by evaporation.

According to a typical embodiment of the present invention, the catalyst is introduced into the reactor in granular form, preferably as a product co-extruded with an inert charge, for example $\gamma$-alumina. A fixed bed is normally used, into which the reagent mixture is passed. The contact time is selected so as to have a conversion ranging from 60 to 80% in processes with recycling of the nonconverted fraction, and from 70 to 90% in "once through" processes without recycling. The space velocity preferably ranges from 0.4 to 8 $h^{-1}$. In a particularly preferred embodiment of the present invention, the contact time is selected in relation to the desired conversion and $R_{H/C}$ ratio, so that these values identify a point within the shaded area in FIG. 1.

The reaction mixture leaving the reactor is analyzed on line by means of one of the known techniques, for example, gaschromatography, and is sent to a distillation/separation step from which the desired middle distillate product is obtained at the head. The high-boiling residue, normally consisting of partly isomerized hydrocarbon waxes, can be advantageously recycled to the hydrocracking step to produce additional middle distillate. The light hydrocarbon fraction (gas and naphtha) with a distillation temperature of less than 150° C., is removed by distillation and normally destined for various uses.

The operating conditions and equipment for carrying out the process of the present invention can be easily set up and optimized by the expert in the field, on the basis of the present description and parameters defined herein. A particularly advantageous aspect of this process lies in the fact that, in most cases, and especially by feeding a mixture of hydrocarbons obtained from the Fischer-Tropsch synthesis, it can be essentially carried out in a single reactive step (hydrocracking), usually combined with a single separation step and recycling downstream of the reactor, without resorting to other distillation and transformation combinations which are described in the known art mentioned above. Numerous obvious variations of this process can however be effected by the expert in the field without creating any additional inventive activity.

The catalyst which characterizes the process of the present invention is a known hydrogenating acid catalyst, which has so far not been used in hydrocracking processes as it was considered more suitable for isomerization reactions. It has been surprisingly found that, by using a mixture of hydrocarbons in the feeding, with the characteristics specified above, and by establishing the conversion $\alpha$ of the high-boiling fraction at a minimum of 40%, preferably from 60 to 90%, more preferably from 65 to 80%, it is possible to obtain, with satisfactory yields, a product not only having the desired content of middle distillate cut, but in which the K/G ratio between the kerosene and gas oil fractions is substantially kept unaltered, if these were, as is customary, already present in significant quantities in the feeding, especially in the case the initial $K_0/G_0$ ratio ranges from 0.50 to 1.10. In addition, the middle distillate thus obtained has a high concentration of isoparaffins which considerably improve the properties at low temperatures with respect to the same cut present in the starting charge, in particular a pour point of the gas oil fraction normally ranging from 9 to −30° C. and a freezing point of the kerosene fraction ranging from −35 to −55° C., for a conversion range of the fraction with a boiling point of over 370° C., ranging from 45 to 95%.

The catalyst which can be used in the process according to the present invention is a bifunctional catalyst, in which a noble metal is supported on a carrier essentially consisting of an amorphous and micro/mesoporous silica-alumina gel with a controlled pore size, with a surface area of at least 500 $m^2/g$ and with a molar ratio $SiO_2/Al_2O_3$ ranging from 30/1 to 500/1, but preferably from 40/1 to 150/1.

According to the present invention, the noble metal suported on the carrier can be selected among the metals of groups 8, 9 and 10 of the periodic table, particularly Co, Ni, Pd and Pt. Palladium and platinum are preferably used. The amount of noble metals normally ranges from 0.05 to 5.0% by weight relative to the weight of the carrier. Particularly advantageous results have been obtained by using palladium and platinum in amounts from 0.2 to 1.0% by weight.

The said carrier is normally obtained starting from a mixture of tetra-alkyl ammonium hydroxide, a compound of aluminum which can be hydrolyzed to $Al_2O_3$, a compound of silicon which can be hydrolyzed to $SiO_2$ and a sufficient quantity of water to dissolve and hydrolyze these compounds, wherein said tetra-alkyl ammonium hydroxide comprises from 2 to 6 carbon atoms in each alkyl residue, said hydrolyzable aluminum compound preferably being an aluminum trialkoxide comprising from 2 to 4 carbon atoms in each alkoxide residue and said hydrolyzable silicon compound being a tetra-alkylorthosilicate comprising from 1 to 5 carbon atoms for each alkyl residue.

Various methods are possible for obtaining different carriers having the above characteristics, for example according to what is described in European patent applications EP-A 340,868, EP-A 659,478 and EP-A 812,804. In particular an aqueous solution of the above compounds is hydrolyzed and gelified by heating, either in a closed environment to the boiling point or a higher value, or in an open environment, below this temperature. The gel thus produced is subsequently subjected to drying and calcination.

The tetra-alkyl ammonium hydroxide which can be used for the purposes of the present invention is selected, for example, from tetraethyl-, propyl-, isopropyl-, butyl-, isobutyl-, terbutyl, and pentyl-ammonium hydroxide and among these tetrapropyl-, tetraisopropyl- and tetrabutyl ammonium hydroxide are preferred. The aluminum trialkoxide is selected, for example, from aluminum triethoxide, propoxide, isopropoxide, butoxide, isobutoxide and terbutoxide and among these aluminum tripropoxide and triisopropoxide are preferred. The tetra-alkyl orthosilicate is selected, for example, from tetramethyl-, tetraethyl-, propyl-, iso-propyl-, butyl-, isobutyl-, terbutyl-, and pentyl-orthosilicate and among these tetraethyl orthosilicate is preferred.

In a typical procedure for the preparation of the carrier for the process according to the present invention, an aqueous solution containing the tetra-alkyl ammonium hydroxide and aluminum trialkoxide is first prepared, operating at a temperature which is sufficient to guarantee an effective dissolution of the aluminum compound. The tetra-alkyl orthosilicate is added to said aqueous solution. This mixture is brought to a temperature suitable for activating the hydrolysis reaction. This temperature depends on the composition of the reaction mixture (usually from 70 to 100° C.). The hydrolysis reaction is exothermic and therefore guarantees self-sustenance, once it has been activated. In addition, the quantities of the constituents of the mixture are such as to respect the molar ratios: $SiO_2/Al_2O_3$ from 30/1 to 500/1, tetra-alkyl ammonium hydroxide/$SiO_2$ from 0.05/1 to 0.2/1 and $H_2O/SiO_2$ from 5/1 to 40/1. The preferred values for these molar ratios are: $SiO_2/Al_2O_3$ from 40/1 to 150/1, tetra-alkyl ammonium hydroxide/$SiO_2$ from 0.05/1 to 0.2/1 and $H_2O/SiO_2$ from 10/1 to 25/1.

The hydrolysis of the reagents and their gelation are carried out operating at a temperature equal to or higher than the boiling point, at atmospheric pressure, of any alcohol which is developed as by-product of said hydrolysis reaction, without elimination or substantial elimination of these alcohols from the reaction environment. The hydrolysis and gelation temperature is therefore critical, and is conveniently maintained at values higher than 65° C. approximately to 110° C. approximately. In addition, in order to maintain the development of the alcohol in the reaction environment, it is possible to operate in an autoclave at autogenous pressure of the system at the pre-selected temperature (normally in the order of 0.11–0.15 absolute MPa), or to operate at atmospheric pressure in a reactor equipped with a reflux condenser.

According to a particular embodiment of the process, the hydrolysis and gelation are carried out in the presence of a quantity of alcohol greater than that which is developed as by-product. For this purpose a free alcohol is added, and preferably ethanol, to the reaction mixture, in a quantity up to a maximum of the molar ratio between alcohol added and $SiO_2$ of 8/1.

The times necessary for completing the hydrolysis and gelation, under the conditions specified above, normally vary from 10 minutes to 3 hours and are preferably in the order of 1–2 hours.

It has also been found to be useful to subject the gel thus formed to aging, by maintaining the reaction mixture in the presence of alcohol and under environmental temperature conditions, for a period in the order of 1–24 hours.

The alcohol is finally removed from the gel which is then dried, preferably operating at reduced pressure (for example 3–6 kPa) at a temperature of 110° C. The dried gel is finally subjected to calcination in an oxidating atmosphere (normally in air), at a temperature ranging from 500 to 700° C. for a period of 4–20 hours and preferably at 500–600° C. for 6–10 hours.

The silica and alumina gel thus obtained has a composition corresponding to that of the reagents used, considering the fact that the reaction yields are practically complete. The molar ratio $SiO_2/Al_2O_3$, therefore, varies from 30/1 to 500/1 and preferably from 40/1 to 150/1, the more preferred values being in the order of 100/1. This gel is amorphous, when subjected to analysis by means of X-ray diffractometry from powders, it has a surface area of at least 500 $m^2/g$ and normally within the range of 600–850 $m^2/g$ and a pore volume of 0.4–0.8 $cm^3/g$.

A metal selected from noble metals of groups 8, 9 or 10 of the periodic table is supported on the micro/meso porous amorphous silica/alumina gel obtained as described above. As already stated hereinbefore, this metal is preferably selected from platinum or palladium, and particularly platinum.

Particularly advantageous results are obtained when the process parameters of the hydrocracking step are selected from those included in the diagram of FIG. 1, and the quantity of noble metal, especially platinum, in the supported catalyst ranges from 0.4 to 0.8%, more preferably from 0.6 to 0.8% by weight with respect to the weight of the carrier.

According to the present invention, it is convenient to distribute the metal uniformly onto the porous surface of the carrier, in order to maximize the effectively active catalytic surface. For this purpose various known methods can be used, such as those described, for example, in European patent application EP-A 582,347, whose content is incorporated herein as reference. In particular, according to the technique for impregnation, the porous carrier having the characteristics of the acid carrier (a) described above, is put in contact with an aqueous or alcohol solution of a compound of the desired metal for a period sufficient to provide a homogeneous distribution of the metal in the solid. This normally requires from a few minutes to several hours, preferably under stirring. Soluble salts suitable for the purpose are, for example, $H_2PtF_6$, $H_2PtCl_6$, $[Pt(NH_3)_4]Cl_2$, $[Pt(NH_3)_4](OH)_2$ and the analogous salts of palladium; also mixtures of salts of different metals are equally included in the scope of the invention. It is convenient to use the minimum quantity of aqueous liquid (usually water or an aqueous mixture with a second inert liquid or with an acid in a quantity of less than 50% by weight) sufficient to dissolve the salt and uniformly impregnate said carrier, preferably with a ratio solution/carrier ranging from 1 to 3. The quantity of metal is selected on the basis of the concentration which is desired to be obtained in the catalyst, as the whole of the metal is fixed onto the carrier.

At the end of the impregnation, the solution is evaporated and the solid obtained is dried and calcined in an inert or reducing atmosphere, under temperature and time conditions analogous to those previously described for the calcination of the carrier.

An alternative impregnation method is by means of ion exchange. In accordance with this, the amorphous silica/alumina gel carrier is put in contact with an aqueous solution of a salt of the metal, as in the previous case, but the deposition takes place by exchange, under conditions made basic (pH between 8.5 and 11) by the addition of a sufficient quantity of an alkaline compound, normally an ammonium hydroxide. The suspended solid is then separated from the liquid by means of filtration or decanting, and dried and calcined as described above.

According to another alternative, the salt of the transition metal can be included in the silica/alumina gel in its preparation step, for example before hydrolysis for the formation of the wet gel, or before its calcination. Although this latter method is advantageously easier to effect, the catalyst thus obtained is slightly less active and selective than that obtained with the two previous methods.

The supported catalyst described above can be used as such in the hydrocracking step of the process according to the present invention, after activation in accordance with one of the methods known and/or described hereunder. According to a preferred embodiment however, said supported catalyst is reinforced by the addition and mixing of a suitable quantity of an inert inorganic solid capable of improving its mechanical properties. In fact, the catalyst is preferably used in granular rather than powder form with a relatively narrow particle distribution. In addition, it is convenient for it to have sufficient mechanical compressive and impact strength to avoid progressive crushing during the hydrocracking step.

Extrusion and pelletizing methods are known for the purpose, which use a suitable inert additive (or binder) capable of providing the above properties, for example, according to the methods described in European patent applications EP-A 550,922 and EP-A 665,055, the latter being preferred, both filed by the Applicant, whose content is incorporated herein as reference.

A typical method for the preparation of the catalyst in extruded form (EP-A 665,055) suitable for the purpose, comprises the following steps:

(a) the solution of the hydrolyzable components obtained as described above is heated to cause its hydrolysis and gelation and obtain a mixture A with a viscosity ranging from 0.01 to 100 Pa·sec;

(b) a binder belonging to the group of boehmites or pseudoboehmites is added first to the mixture A, in a weight ratio with the mixture A ranging from 0.05 to 0.5, followed by a mineral or organic acid in a quantity ranging from 0.5 to 8.0 g per 100 g of binder;

(c) the mixture obtained under point (b) is heated under stirring to a temperature ranging from 400 to 90° C. until a homogeneous paste is obtained, which is subjected to extrusion and granulation;

(d) the extruded product is dried and calcined in an oxidating atmosphere.

Plasticizers, such as methylcellulose, are also preferably added in step (b) to favour the formation of a homogenous and easily processable mixture.

In this way, a granular acid carrier is obtained, containing a quantity of 30 to 70% by weight of inert inorganic binder, the remaining quantity consisting of amorphous silica-alumina essentially having the same porosity, surface extension and structure characteristics described above for the same gel without the binder. The granules are conveniently in the form of pellets having a size of around 2–5 mm in diameter and 2–10 mm in length.

The supporting step of the noble metal onto the granular acid carrier is then carried out with the same procedure described above.

Before being used in the process according to the present invention, the catalyst is normally subjected to activation in a reducing atmosphere, according to one of the known methods suitable for the purpose, which can also be carried out directly in the reactor pre-selected for the hydrocracking reaction. A typical method uses the procedure described hereunder:

1) 2 hours at room temperature in a stream of nitrogen;
2) 2 hours at 50° C. in a stream of hydrogen;
3) heating to 310–360° C. with an increase rate of 3° C./min in a stream of hydrogen;
4) temperature constant at 310–360° C. for 3 hours in a stream of hydrogen and cooling to 200° C.

During the activation, the pressure in the reactor is maintained at 30 to 80 atm.

The process according to the present invention allows a mixture of prevalently linear aliphatic high-boiling hydrocarbons to be transformed, with excellent yields and without additional chemical treatment to the hydrocracking reaction, into a mixture of middle distillate hydrocarbons having an optimum combination of properties in terms of isomerized fraction, K/G ratio, pour point, cetane number, freezing point, etc. In addition it is possible with this process to effect an optimum recycling of the non-converted high-boiling residue.

Some examples are provided hereunder for a more detailed description of the present invention and for its embodiment, which however should in no way be considered as limiting the overall scope of the invention itself.

EXAMPLE

The following analysis and characterization methods were used:

X-ray diffractometry from powders (XRD): the analysis was carried out using a Philips vertical diffractometer equipped with a proportional impulse counter; the radiation was CuKa ($\lambda$=1.54178 Å).

Pore volume measurement: the total pore volume was determined by means of the DFT method (density functional theory).

Specific surface area measurement: the specific surface area was evaluated by means of a BET linear graph with two parameters within the p/p° range of 0.01–0.2 and by means of the DFT (density functional theory) method.

Ultimate tensile stress measurement: the axial and radial ultimate tensile stress values were measured on the single catalyst pellet using a QUESTAR-90 instrument produced by Stevens. The data indicated are the average of 20 determinations. Pour point: according to the regulation ASTM D97

Freezing point: according to the regulation ASTM D5901

Smoke point: according to the regulation ASTM D1322

Blending cetane number: obtained by calculation starting from the data obtained according to regulation ASTM D613 with mixtures having a different content of gas oil coming from the hydrocracking process of waxes.

Reagents and Materials

During the preparations described in the examples, the commercial reagents listed hereunder were used:

| | |
|---|---|
| tetrapropylammonium hydroxide (TPA-OH) | SACHEM |
| aluminum tri-isopropoxide | FLUKA |
| tetraethylsilicate | DYNAMIT NOBEL |
| alumina (VERSAL 250, Pseudo-Bohemite) | LAROCHE |
| methylcellulose (METHOCEL) | FLUKA |

The reagents and/or solvents adopted which are not indicated above are those most commonly used and can be easily found at commercial suppliers specialized in the field.

Preparative Example 1

Catalyst "CATA 1"

A series of catalytic compositions was prepared for carrying out the hydrocracking process object of the present invention, according to the method described hereunder.

(i) Preparation of the Silica-alumina Gel

A 100 liter reactor was preliminarily washed with 75 liters of a solution at 1% by weight of tetrapropylammonium hydroxide (TPA-OH) in demineralized water, the liquid being maintained under stirring for 6 hours at 120° C. The washing solution is discharged and 23.5 liters of demineralized water, 19.6 kg of aqueous solution at 14.4% by weight of TPA-OH (13.8 moles) and 600 g of aluminum tri-isopropoxide (2.94 moles) are introduced. The mixture is heated to 60° C. and maintained under stirring at this temperature for 1 hour, in order to obtain a limpid solution. The temperature of the solution is then brought to 90° C. and 31.1 kg of tetraethylsilicate (149 moles) are rapidly added. The reactor is closed and the stirring rate is regulated to about 1.2 m/s, the mixture being maintained under stirring for three hours at a temperature ranging from 80 to 90° C., with thermostat control to remove the heat produced by the hydrolysis reaction. The pressure in the reactor rises to about 0.2 MPag. At the end the reaction mixture is discharged and cooled to room temperature, obtaining a homogeneous and relatively fluid gel (viscosity 0.011 Pa·s) having the following composition molar rations:

$$SiO_2/Al_2O_3=101 \quad TPA\text{-}OH/SiO_2=0.093 \quad H_2O/SiO_2=21$$

(ii) Preparation of the Extruded Product 1150 g of alumina (VERSAL 150), previously dried for 3 hours in air at 150° C. and 190 g of methylcellulose are charged into a 10 liter mixer, maintained at a stirring rate of 70–80 revs per minute. 5 kg of the silica-alumina gel prepared as described above and left to rest for about 20 hours, are then added over a period of about 15 minutes, and the mixture is left under stirring for about 1 hour. 6 g of glacial acetic acid are introduced and the temperature of the mixer is brought to about 60° C., the stirring being continued until a homogeneous paste, having the desired consistency for the subsequent extrusion, is obtained.

The homogeneous paste obtained as described above is charged into a HUTT type extruder, extruded and cut into cylindrical pellets of the desired size (about 2×4 mm). The product is left to rest for about 6–8 hours and then dried maintaining it in a stream of air at 100° C. for 5 hours. It is finally calcined in muffle at 550° C. for 3 hours in a stream of nitrogen and for a further 8 hours in air.

In this way a porous solid is obtained, with acid characteristics, essentially consisting of silica/alumina (yield 95% with respect to the respective initial reagents), having a crushing strength (axial) of 249 kg/cm$^2$ and a BET of 608 m$^2$/g. Upon X-ray examination, the solid proves to be substantially amorphous (absence of lines corresponding to crystalline zones).

(iii) Impregnation of the Carrier with Platinum 12.1 ml of an aqueous solution of hydrochloric acid 0.6 M containing 4.5 g/l of hexachloroplatinic acid ($H_2PtCl_6$, 0.133 mmoles) are dripped, under slow stirring, into a glass container containing 10 g of the porous solid prepared as described above. The mixture thus obtained is left under stirring for 16 hours at room temperature. The water is then evaporated at 60° C. in a stream of air, over a period of about 1 hour. The solid obtained is then dried, maintaining it at 150° C. for two hours, and is calcined by heating in muffle, in a stream of air, from room temperature to 500° C. over a period of three hours. At the end, a supported catalyst for hydrocracking is obtained, having the following characteristics:

59.8% by weight of amorphous silica/alumina (molar ratio $SiO_2/Al_2O_3$=102)

39.9% by weight of alumina (pseudo-bohemite)

0.3% by weight of platinum

Pore volume: 0.6 ml/g

BET: 600 m$^2$/g

Crushing strength: 10 kg/cm$^2$ (radial); 90 kg/cm$^2$ (axial)

Preparative Example 2

Catalyst "CATA 2"

A second catalytic composition was prepared using the same procedure described in preparative example 1, but using in step (iii) 24.1 ml of said aqueous solution of hydrochloric acid 0.6 M containing 4.5 g/l of hexachloroplatinic acid (0.165 mmoles). At the end a solid was obtained, suitable as a supported catalyst for hydrocracking processes, essentially having the same characteristics as the previous one, but containing 0.6% by weight of platinum (CATA 2).

Example 1

Hydrocracking of Mixtures of Linear Hydrocarbons

A semi-solid mixture (waxes) of linear aliphatic hydrocarbons coming from a Fischer-Tropsch type synthesis, is subjected to hydrocracking treatment according to the present invention. For this purpose a fixed bed tubular reactor is used, having a useful charge volume of 15 ml, corresponding to a height of the catalytic bed in the isotherm region of about 10 cm. The reactor is equipped with suitable connections for the continuous feeding of the reagents in equicurrent and the removal of the reaction mixture. Hydrogen is fed at the desired pressure by means of a mass flowmeter; the hydrocarbon mixture is maintained in liquid state at a temperature of about 110° C. and fed by means of a pump.

The temperature of the reactor is controlled by means of a thermostatic system capable of operating at up to 400° C. An adequate analytic instrumentation is connected on line for the real time analysis of the composition of the reaction product.

8 g of the catalyst "CATA 1" (as prepared according to preparative example 1) are charged into the reactor and activated in accordance with the method described above.

A mixture of hydrocarbons is used as feeding, identified as "mixture A", coming from a Fischer-Tropsch synthesis process, and has the composition indicated in table 3, in which the weight percentages of the distillate fractions are listed in the corresponding temperature and final residue ranges. Table 3 also specifies the quantities of alcohols possibly present, which are formed in a quantity of 2 to 5% by weight, as by-products of the Fischer-Tropsch synthesis.

The same table 3 also indicates the composition of two hydrocarbon model mixtures (mixtures B and C) used in the following examples, which are obtained artificially by mixing pure linear paraffins or mixtures with a very narrow distribution, in order to represent a different distribution of a Fischer-Tropsch mixture.

TABLE 3

| Feeding mixture | A (weight %) | B (weight %) | C (weight %) |
|---|---|---|---|
| Fraction < 150° C. | 4.9 | absent | absent |
| Kerosene (from 150 to 260° C.) | 13.9 | 30.0 | 30.40 |
| Gas oil (from 260 to 370° C.) | 25.8 | 30.8 | 30.37 |
| Fraction > 370° C. | 55.4 | 39.2 | 39.23 |
| Alcohols (weight %) | 4.7 | absent | absent |

A hydrocracking test was carried out on mixture A, at a total pressure of about 5 MPa (48–51 ata) and a weight ratio hydrogen/(hydrocarbon mixture) of about 0.1. The reaction temperatures was set at 340° C., as specified in table 4 below, the contact time was regulated so as to have the desired conversion degree α at the end. Table 4 also indicates the composition data relating to the yields in the various distillation cuts obtained at the end of the process. The usual fractionation is carried out on the outgoing mixture by means of gaschromatographic analysis, and the conversion degree of the hydrocarbon fraction having more than 22 carbon atoms $C_{22}$+, more or less corresponding to the fraction with a boiling point >370° C., is measured on this basis. Table 4 also specifies the complete fractionations of the products obtained and the weight ratio ($K_F/G_F$) between the kerosene fraction and the gas oil fraction in the mixture leaving the hydrocracking reactor, which, by comparison with the K/G ratio in the feeding mixture A, allows the $R_{K/G}$ ratio, also indicated in table 4, to be calculated.

Examples 2–9

Various hydrocracking tests were carried out on mixtures A and B according to previous table 3, using the same equipment, the same catalyst and the same general conditions of total pressure and weight ratio hydrogen/(hydrocarbon mixture) indicated in example 1 above. The reaction temperatures and residence times were established in the different cases according to what is correspondingly indicated in table 4 below, which also specifies the results obtained in terms of composition of the mixture leaving the reactor, conversion α and $R_{K/G}$

TABLE 4

Hydrocracking on mixtures of linear hydrocarbons.

| Example | Temp. (° C.) | WHSV (h−1) | Feeding mixture | $C_{22}$+ conversion | Composition after hydrocracking (%) distillation intervals of fractions (° C.) <150 | 150–260 | 260–370 | >370 |
|---|---|---|---|---|---|---|---|---|
| 1 | 340 | 3.7 | B | 46 | 5.6 | 37.5 | 35.7 | 21.2 |
| 2 | 340 | 2.3 | B | 80 | 9.0 | 40.4 | 42.7 | 7.9 |
| 3 | 350 | 6.2 | B | 56 | 9.6 | 37.9 | 35.3 | 17.2 |
| 4 | 350 | 3.7 | B | 84 | 11.3 | 42.3 | 40.2 | 6.2 |
| 5 | 340 | 2.1 | A | 42 | 8.2 | 19.4 | 41.2 | 31.2 |
| 6 | 340 | 1.1 | A | 76 | 15.6 | 24.9 | 46.9 | 12.6 |
| 7 | 350 | 2.0 | A | 53 | 12.6 | 21.3 | 40.9 | 25.2 |
| 8 | 350 | 1.3 | A | 71 | 18.0 | 24.5 | 44.8 | 12.7 |
| 9 | 355 | 2.0 | B | 93 | 14.0 | 43.1 | 40.2 | 2.7 |
| 10(*) | 330 | 3.6 | B | 72 | 28 | 42 | 19 | 11 |
| 11(*) | 225 | 6.7 | B | 39 | 23 | 26 | 27 | 24 |

| Example | $K_F/G_F$ | $R_{(K/G)}$ | $(F.P.)_{Ker}$ (° C.) | $(P.P)_{gas\ oil}$ (° C.) | $(S.P)_{Ker}$ mm | Cetane nr. BCN | Selectivity middle distillate |
|---|---|---|---|---|---|---|---|
| 1 | 1.05 | 1.08 | −36 | −14 | >42.8 | >76 | 0.69 |
| 2 | 0.94 | 0.96 | −39 | −20 | >42.8 | >76 | 0.71 |
| 3 | 1.07 | 1.10 | −38 | −18 | >42.8 | >76 | 0.56 |
| 4 | 1.05 | 1.08 | −41 | −23 | >42.8 | >76 | 0.65 |
| 5 | 0.47 | 0.87 | −35 | −9 | >42.8 | >76 | 0.86 |
| 6 | 0.53 | 0.98 | −38 | −15 | >42.8 | >76 | 0.75 |
| 7 | 0.52 | 0.96 | −36 | −12 | >42.8 | >76 | 0.74 |
| 8 | 0.54 | 1.0 | −37 | −14 | >42.8 | >76 | 0.69 |
| 9 | 1.07 | 1.1 | −45 | −25 | >42.8 | >76 | 0.62 |
| 10(*) | 2.2 | 2.26 | n.d. | n.d. | n.d. | n.d. | 0.00 |
| 11(*) | 0.96 | 0.98 | n.d. | n.d. | n.d. | n.d. | −0.51 |

(*)Comparative example

Example 10 (comparative)

For comparative purposes, a hydrocracking test with feeding B was carried out, but using, instead of the catalyst CATA 1 of the present invention, a catalyst consisting of platinum supported on a commercial amorphous silicaalumina (PK 200) having the following characteristics:

Concentration Pt=0.5% by weight;

Pore volume=0.42 ml/g;

Surface area=460 $m^2/g$;

Molar ratio $SiO_2/Al_2O_3$=15.2

The results obtained in terms of conversion and composition of the outgoing mixture are summarized in table 4 above. As is evident, although the conversion is lower than those of examples 2 and 4, the selectivity to middle distillate is considerably lower and the increase in the kerosene/gas oil ratio is much higher.

Example 11 (comparative)

For comparative purposes, a hydrocracking test with the same feeding as example 10 above, was carried out, but using, instead of the catalyst CATA 1 of the present invention, a catalyst consisting of platinum supported on commercial β-zeolite (PQ) having the following characteristics:

Concentration Pt=0.5% by weight;

Surface area=651 $m^2/g$;

Molar ratio $SiO_2/Al_2O_3$=25

The results obtained in terms of conversion and composition of the outgoing mixture are summarized in table 4 above. On examining the data, it can be seen that also at low conversion values of the $C_{22}$+ fraction, there is a selectivity to middle distillates which is actually negative.

Examples 12

Hydrocracking of Mixtures of Linear Hydrocarbons

Various hydrocracking tests were carried out on hydrocarbon mixture C of table 3 above, using the same equipment and the same general conditions of total pressure and temperature (340° C.) as example 1 above. The type of catalyst (CATA 1 or CATA 2) and the $R_{H/C}$ ratio were established in the different cases according to what is correspondingly indicated in Table 5 below, which also specifies the conversion degrees reached and the characteristics of the products obtained in terms of composition of the mixture leaving the reactor, selectivity and $R_{K/G}$ ratio.

Table 5 also specifies the complete fractionations of the products obtained and the weight ratio ($K_F/G_F$) between the kerosene fraction and the gas oil fraction in the mixture leaving the hydrocracking reactor, which, in this case, is equal to the $R_{K/G}$ ratio, the $K_0/G_0$ ratio in the feeding mixture C being practically equal to 1 (Table 3).

As can be seen from Table 5, when the various tests are carried out under conditions which identify points within the area defined by points ABCD, in the diagram of FIG. 1, properties of the kerosene and gas oil fractions can be obtained "according to specification" by means of a simple and direct process.

TABLE 5 hydrocracking on mixtures of linear hydrocarbons.

| EXAMPLES | 1 | 2 | 3 | 4 |
|---|---|---|---|---|
| $R_{H/C}$ | 0.05 | 0.08 | 0.05 | 0.08 |
| Catalyst | CATA 1 | CATA 1 | CATA 2 | CATA 2 |
| Convers. $C_{22}$+ (%) | 63.0 | 89.8 | 71.4 | 82.9 |
| Composition after "hydrocracking" (%) (distillation intervals) fra- | | | | |
| <150 | 9.1 | 12.1 | 9.8 | 10.1 |
| 150–260 | 40.3 | 45.6 | 43.1 | 44.5 |
| 260–370 | 36.1 | 38.3 | 35.9 | 38.7 |
| >370 | 14.5 | 4.0 | 11.2 | 6.7 |

TABLE 5-continued hydrocracking on mixtures of linear hydrocarbons.

| EXAMPLES | 1 | 2 | 3 | 4 |
|---|---|---|---|---|
| $(K_F/G_F)$ | 1.12 | 1.19 | 1.20 | 1.15 |
| $R_{(K/G)}$ | 1.12 | 1.19 | 1.20 | 1.15 |
| $(\text{Freezing Point})_{KER.}$ (° C.) | −47 | −47 | −49 | −48 |
| $(\text{Pour Point})_{GASOIL}$ (° C.) | −20 | −22 | −22 | −28 |
| $(\text{Smoke Point})_{KER.}$ (° C.) | >42.8 | >42.8 | >42.8 | >42.8 |
| $(BCN)_{GASOIL}$ | 79 | 75 | 76 | 78 |
| Middle distillate selectivity | 0.63 | 0.66 | 0.65 | 0.69 |

What is claimed is:

1. A process for the preparation of a mixture of hydrocarbons which can be used as middle distillate fuel starting from a mixture of substantially linear hydrocarbons comprising at least 20% of a high-boiling fraction having a distillation temperature of over 370° C., said process comprising a hydrocracking step wherein said mixture of substantially linear hydrocarbons is heated in the presence of hydrogen to a temperature ranging from 250 to 450° C. and a total pressure of 0.5 to 15 MPa, for a time sufficient to convert at least 40% of said high boiling fraction into a fraction of hydrocarbons which can be distilled at a temperature lower than 370° C., wherein said hydrocracking step is carried out in the presence of a supported catalyst comprising:

(A) a carrier of an acid nature comprising a calcined gel of silica-alumina amorphous to X-rays, having a molar ratio $SiO_2/Al_2O_3$ between silica and alumina within the range of 30 and 500, a surface area ranging from 500 to 1000 $m^2/g$, with a porosity ranging from 0.2 to 0.8 ml/g, with an average pore diameter within the range of 10 and 40 Å;

(B) one or more noble metals of groups 8, 9 or 10 of the periodic table, deposited on said carrier (A) in a quantity ranging from 0.05 to 5% by weight.

2. The process according to claim 1, wherein said mixture of substantially linear hydrocarbons comprises from 10 to 80% by weight of middle distillate subdivided into kerosene and gas oil fractions, wherein the $R_{K/G}$ ratio has values ranging from 0.9 to 1.3, said ratio being defined as follows:

$$R_{K/G} = \frac{K_F / G_F}{K_0 / G_0}$$

herein $K_0/G_0$ represents the weight ratio between the kerosene fraction and the gas oil fraction in the feeding mixture, and $K_F/G_F$ represents the ratio between the same fractions in the mixture obtained at the end of said hydrocracking step.

3. The process according to claim 1, wherein said mixture of substantially linear hydrocarbons comprises a portion of alcohols, wherein said portion of alcohols is at least partly removed by an additional preliminary distillation or selective hydrogenation step.

4. The process according to claim 3, wherein said portion of alcohols is present in an amount of 5 to 10% by weight of said mixture of substantially linear hydrocarbons.

5. The process according to claim 1, comprising, in addition to and downstream of said hydrocracking step, a fractionation step by distillation in which a low-boiling distillate cut at a temperature lower than 150° C., a middle distillate cut at a temperature ranging from 150 to 370° C. and a residue with a distillation temperature higher than 370° C., are obtained.

6. The process according to claim 5, wherein said residue is recycled as feeding to said hydrocracking step.

7. The process according to claim 5, wherein said middle distillate is obtained subdivided into kerosene and gas oil fractions.

8. The process according to claim 1, wherein said mixture of linear hydrocarbons is obtained by a Fischer-Tropsch type process.

9. The process according to claim 1, wherein from 60 to 95% of said high-boiling fraction is converted into a mixture of hydrocarbons with a boiling point equal to or lower than 370° C.

10. The process according to claim 1, wherein the carrier (A) of said catalyst has a porosity ranging from 0.3 to 0.6 ml/g, a BET surface within the range of 600–850 $m^2/g$, and a molar ratio $SiO_2/Al_2O_3$ ranging from 40/1 to 150/1.

11. The process according to claim 1, wherein the noble metal (B) of said catalyst is platinum or palladium.

12. The process according to claim 1, wherein said catalyst is in the form of a granular extruded product and comprises from 30 to 70% by weight of an inert binder.

13. The process according to claim 12, wherein said catalyst is obtained by a process which comprises mixing the amorphous silica-alumina and the binder before calcining.

14. The process according to claim 1, wherein said catalyst is subjected to a preliminary activation step in a reducing atmosphere.

15. The process according to claim 1, which is carried out at a weight hour space velocity (WHSV) of from 0.4 to 6.0 $h^{-1}$, and at a ratio $R_{H/C}$ between hydrogen and the hydrocarbon mixture fed to the reactor of from 0.03 to 0.2.

16. The process according to claim 15, wherein the weight ratio $R_{H/C}$ between the hydrogen and the hydrocarbon mixture fed is at least 0.03 but lower than 0.10, said noble metal (B) in the catalyst being palladium or platinum in a quantity ranging from 0.2 to 1.0% by weight with respect to the carrier (A), and said high-boiling fraction fed having an $\alpha$ conversion degree ranging from 0.60 to 0.90.

17. The process according to claim 16, which is carried out with an $\alpha$ conversion degree and $R_{H/C}$ ratio having values within the shaded area defined by points ABCD of FIG. 1 of the specification.

18. The process according to claim 1, wherein the noble metal (B) of said catalyst comprises platinum, palladium, or a mixture thereof, in a quantity ranging from 0.4 to 0.8% by weight with respect to the weight of the carrier.

19. The process according to claim 11, wherein the noble metal (B) is platinum.

20. The process according to claim 12, wherein the inert binder is selected from the group consisting of boehmites and pseudo-boehmites.

21. The process according to claim 14, wherein the reducing atmosphere consists of hydrogen or a mixture of gases containing hydrogen.

* * * * *